US008322527B2

(12) United States Patent
Lai

(10) Patent No.: US 8,322,527 B2
(45) Date of Patent: Dec. 4, 2012

(54) LOADING DEVICE FOR LOADING OPTICAL ELEMENTS

(75) Inventor: Chien-Nan Lai, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 42 days.

(21) Appl. No.: 13/172,868

(22) Filed: Jun. 30, 2011

(65) Prior Publication Data

US 2012/0279894 A1 Nov. 8, 2012

(30) Foreign Application Priority Data

May 6, 2011 (TW) ..... 100115943

(51) Int. Cl.
*B65D 85/38* (2006.01)

(52) U.S. Cl. ..... 206/316.1; 206/557

(58) Field of Classification Search ..... 206/316.1, 206/5, 5.1, 559, 560, 562, 561, 557, 565, 206/503, 509, 511, 512
See application file for complete search history.

(56) References Cited

U.S. PATENT DOCUMENTS 2,366,886 A * 1/1945 Van Tuyl ..... 206/3
2,761,558 A * 9/1956 McLean, Jr. ..... 206/456
2,965,226 A * 12/1960 Ettlinger, Jr. ..... 206/564
3,672,495 A * 6/1972 Bauer et al. ..... 206/712
3,946,864 A * 3/1976 Hutson ..... 206/725
4,494,667 A * 1/1985 Griffith ..... 220/486
5,094,609 A * 3/1992 Kindt-Larsen ..... 425/445
5,394,988 A * 3/1995 Edwards et al. ..... 206/5.1
5,538,134 A * 7/1996 Pitesky ..... 206/438
5,745,230 A * 4/1998 Edwards et al. ..... 356/124
5,794,783 A * 8/1998 Carter ..... 206/725
6,044,976 A * 4/2000 Bandrowski et al. ..... 206/493
6,050,406 A * 4/2000 Nomura et al. ..... 206/316.1
6,475,432 B2 * 11/2002 Balmer ..... 422/22
6,914,771 B2 * 7/2005 Ono et al. ..... 361/820
2007/0215517 A1 * 9/2007 Holler ..... 206/725

* cited by examiner

*Primary Examiner* — Jacob K Ackun
*Assistant Examiner* — Jenine Pagan
(74) *Attorney, Agent, or Firm* — Altis Law Group, Inc.

(57) ABSTRACT

A loading device includes a number of stacked loading plates and a fixing assembly. Each loading plate is used for loading a number of elements. The fixing assembly fixes the loading plates together. Each loading plate includes a first surface and a second surface opposite to the first surface. A number of spacer blocks protrude from the first surface, forming an interval between two adjacent loading plates. Each loading plate defines a number of through holes passing through the first surface and the second surface. A number of blocks are positioned on the second surface. Each through hole is surrounded by at least three blocks. Each of the at least three blocks has an arc surface facing a corresponding through hole. The arc surfaces of the at least three blocks cooperatively define a groove communicating with the corresponding through hole.

12 Claims, 5 Drawing Sheets

LOADING DEVICE FOR LOADING OPTICAL ELEMENTS

BACKGROUND

1. Technical Field

The present disclosure relates to loading devices and, particularly, to a loading device for loading optical elements.

2. Description of Related Art

Optical elements (e.g. lenses, barrels) need to be washed, dried, and then assembled to form image capturing devices. However, the elements are received in metallic nets during the washing processing, in trays during the drying processing, and then are received in plastic bags to be transported to assembly machines. The elements further need to be received in assembly plates during the assembling process. In other words, the elements need to be transferred to different loading devices during different steps, which will waste a lot of time and reduce the production efficiency.

Therefore, it is desirable to provide a loading device that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
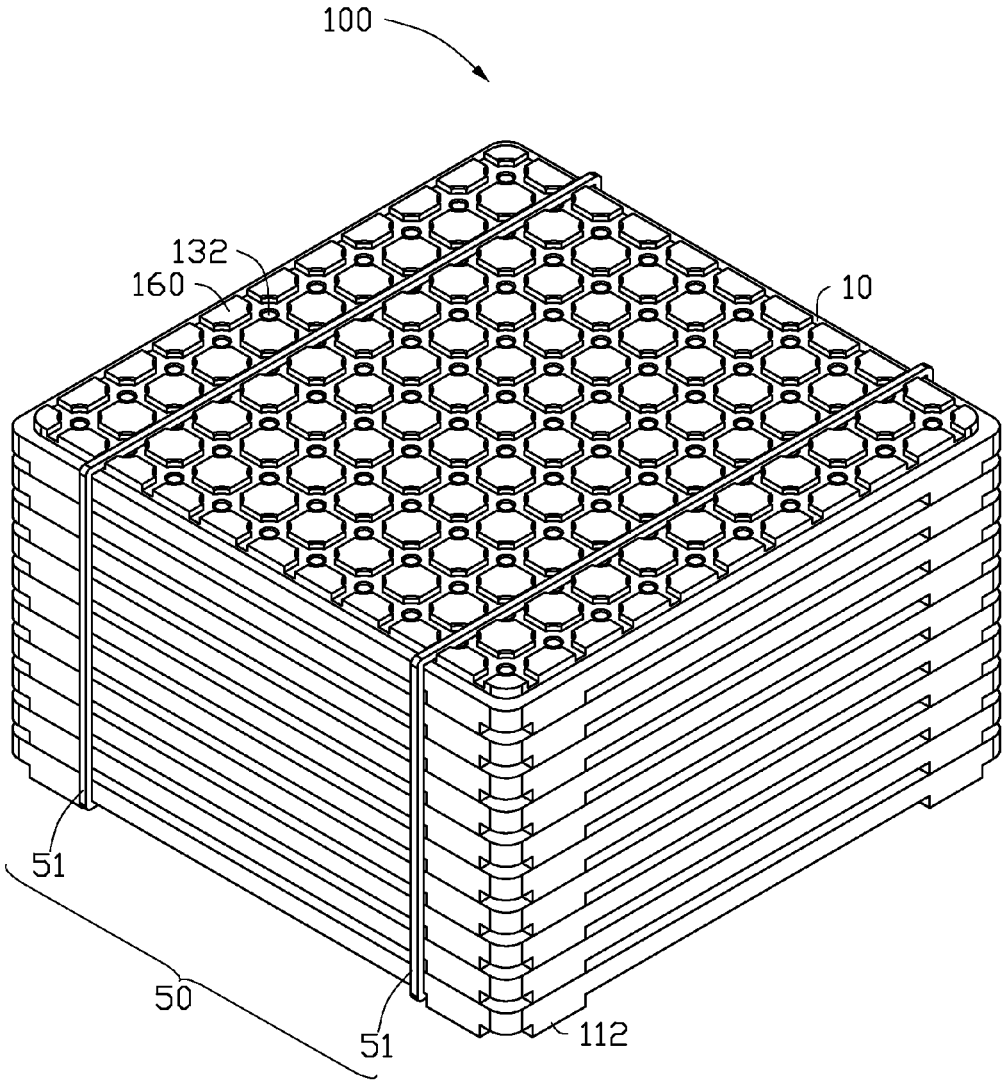
FIG. 1 is a schematic perspective view of a loading device, according to an exemplary embodiment.
Figure 2:
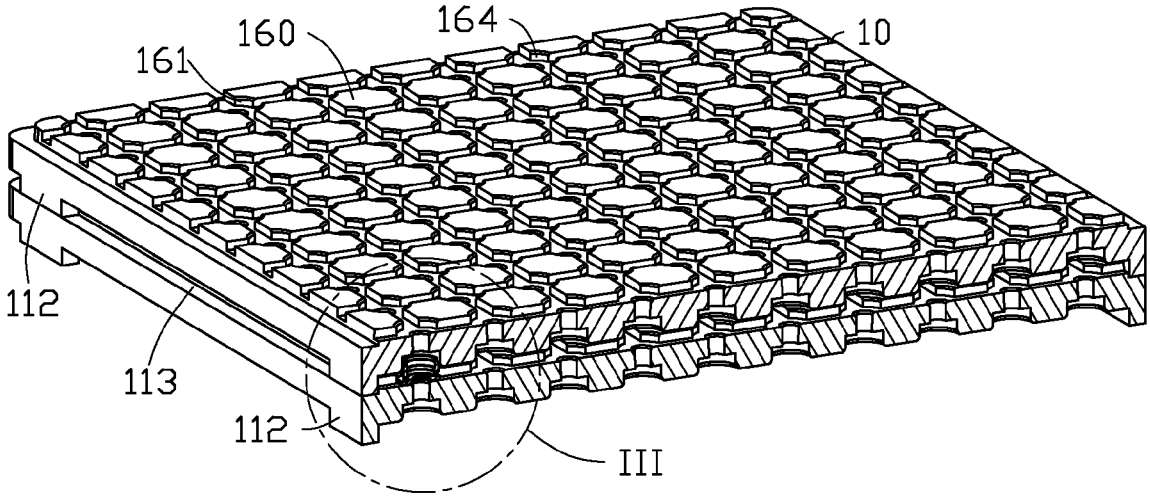
FIG. 2 is a cutaway perspective view of two loading plates of the loading device of FIG. 1.
Figure 3:
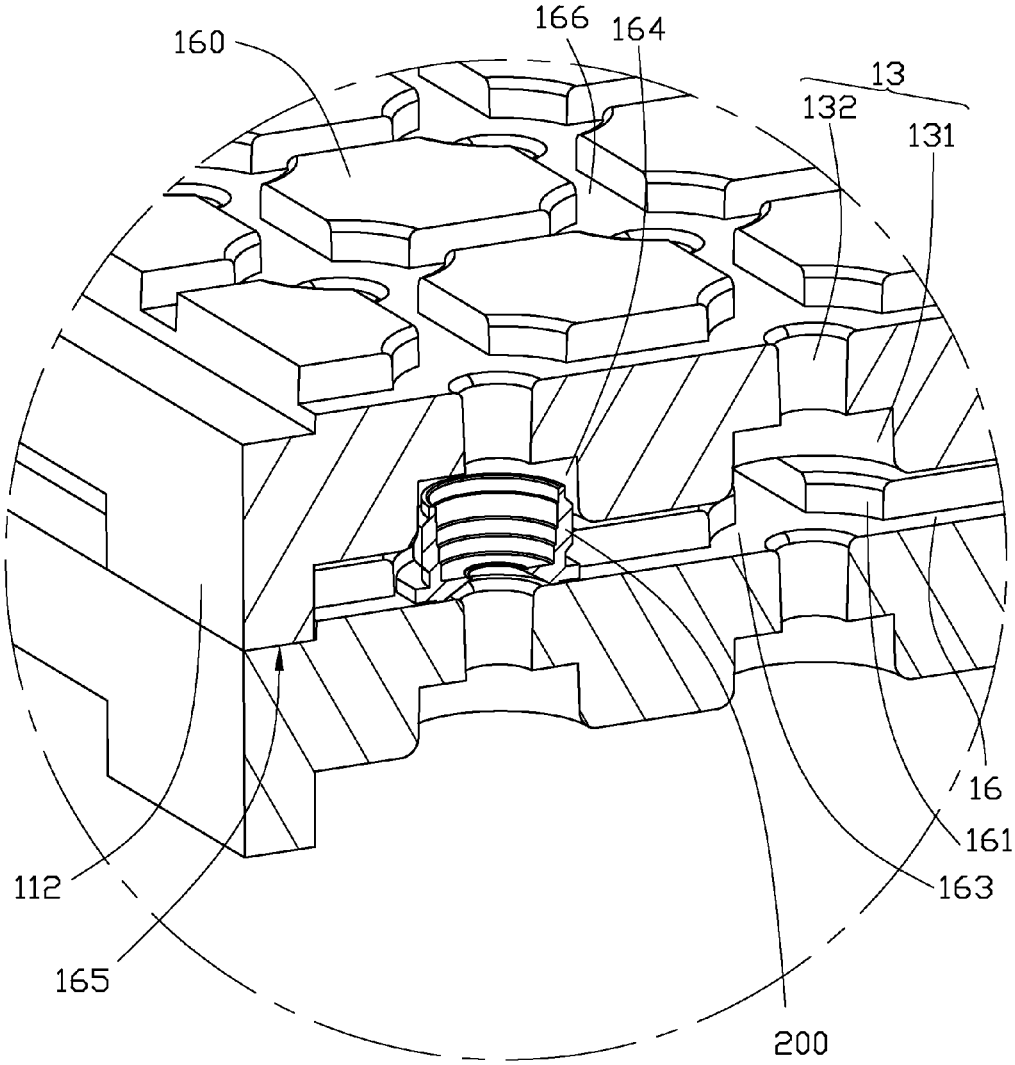
FIG. 3 is a schematic enlarged view of circled area III of the loading device of FIG. 2.

Referring to FIGS. 1-3, a loading device 100 used for loading elements 200 (e.g. barrels, lenses), according to an embodiment, includes a number of loading plates 10 and a fixing assembly 50. The fixing assembly 50 is used for fixing the loading plates 10 together. In this embodiment, the fixing assembly 50 is two rubber bands 51.

Figure 4:
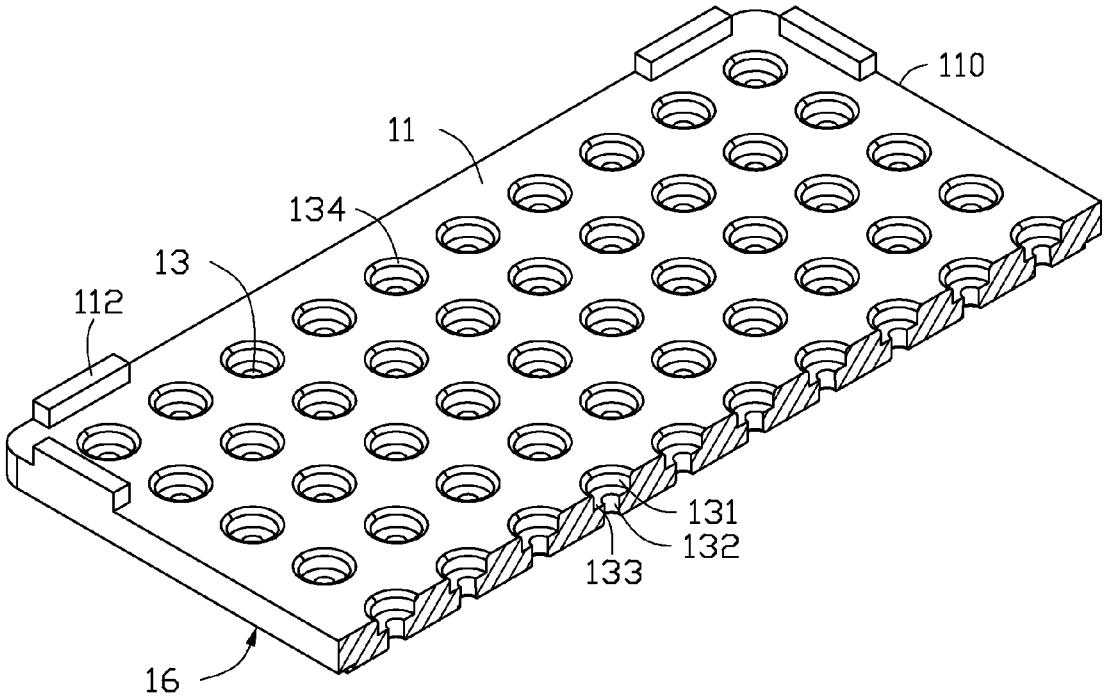
FIG. 4 is a cutaway perspective view of a loading plate of the loading device of FIG. 1.
Figure 5:
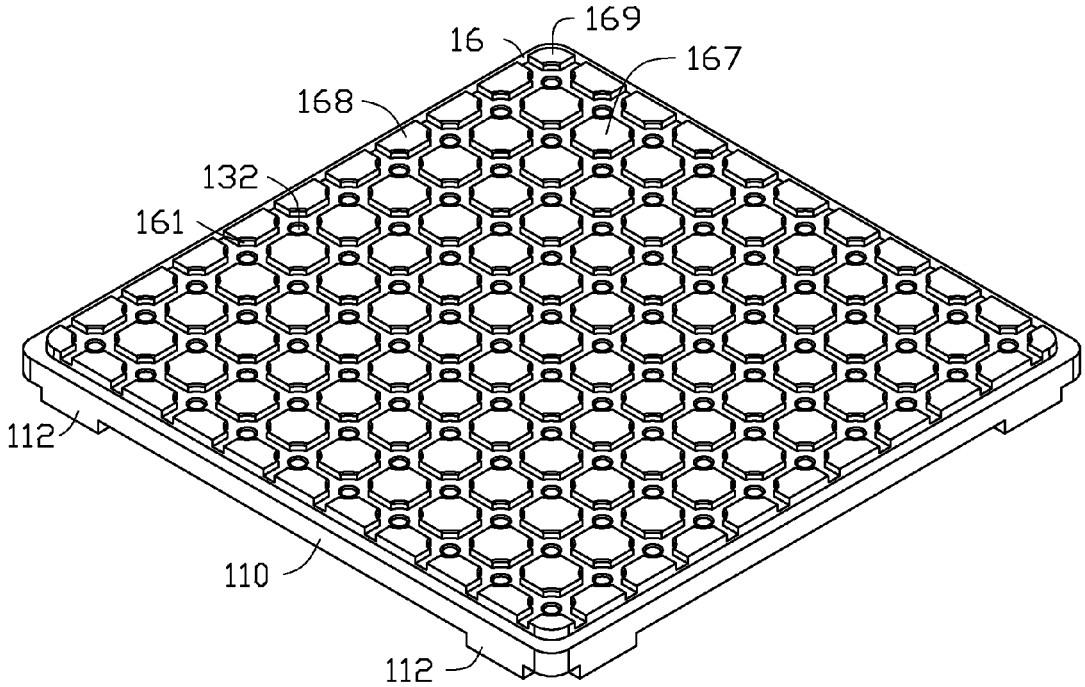
FIG. 5 is a schematic perspective view of a loading plate of the loading device of FIG. 1.

Also referring to FIGS. 4&5, each of the loading plates 10 is made of heat-resisting material. Each loading plate 10 is substantially square-shaped, and includes a first surface 11 and a second surface 16 opposite to the first surface 11. The first surface 11 includes four sides 110. Vertically protruding from each side 110 of the first surface 11 are two spacer blocks 112 forming an interval 113 (see FIG. 2) between the two adjacent loading plates 10. The two spacer blocks 112 of two opposite sides 110 are aligned respectively, and thus each of the two rubber bands 51 can be stopped by two aligned spacer blocks 112 of two opposite sides 110 (see FIG. 1). The number of the spacer blocks 112 is not limited to this embodiment.

Each loading plate 10 defines a number of through holes 13 passing through the first surface 11 and the second surface 16. The through holes 13 are disposed in array, and two adjacent through holes 13 are spaced from each other. In other embodiments, the through holes 13 also can be disposed in a honeycomb structure.

Referring to FIG. 3, each through hole 13 includes a first hole 131 and a second hole 132 coaxial with the first hole 131. The first hole 131 is adjacent to the first surface 11. The second hole 132 is adjacent to the second surface 16. The diameter of the first hole 131 is larger than that of the second hole 132, a stepped surface 133 is formed at the joint portion between the first hole 131 and the second hole 132. The joint portion of the first hole 131 and the first surface 11 form an inclined surface 134 so the elements 200 can easily enter the first hole 131.

A number of blocks 160 are protruding from the second surface 16 around the second holes 13. The blocks 160 are arranged in array, and two adjacent blocks 160 are spaced to form a channel 166. Each second hole 132 is surrounded by four blocks 160. A surface of each block 160 facing the second hole 132 defines an arc surface 161. The arc surfaces 161 of the blocks 160 around a corresponding second hole 132 to cooperatively define a groove 163. Each groove 163 is circular shaped, a diameter of each first hole 131 is less than that of each groove 163. The corresponding second hole 132 is defined at the center of the groove 163. Two adjacent grooves 163 communicate via the channel 166. Referring to FIG. 3, each groove 163 and the corresponding first hole 131 of the loading plate 10 cooperatively define a receiving space (not labeled) to receive the element 200, preventing the elements 200 from flying away from the loading device 10. Along the direction perpendicular to the second surface 16, the receiving space communicates with the second holes 132 of two adjacent loading plates 10. Along the direction parallel to the second surface 16, the receiving space communicates with the interval 113 of the two adjacent loading plates 10. Each side of the second surface 16 defines a notch 165 to receive the corresponding spacer blocks 112 of the adjacent loading plate 10, making sure that the corresponding through holes 13 of the loading plates 10 are coaxial with each other respectively.

Referring to FIG. 5, the blocks 160 of each loading plate 10 include a number of middle blocks 167, a number of side blocks 168, and four corner blocks 169. The side blocks 168 are arranged adjacent to the four sides of the second surface 16. The corner blocks 169 are disposed in the four corners of the second surface 16. The middle blocks 167 are arranged in array in the area of the second surface 16 surrounded by the side blocks 168 and the corner blocks 169. Each middle block 167 is substantially square-shaped. In this embodiment, a cross-sectional area of each side block 168 is half of that of each middle block 167. a cross-sectional area of each corner block 169 is quarter of that of each middle block 167. In other embodiments, the cross-sectional area of each side block 168 and each corner block 169 also can be the same as that of the middle block 167.

In use, the elements 200 are received in the grooves 163 of the second surface 16, and then the loading plates 10 are stacked one by one to make the first hole 131 of the adjacent loading plate 10 cover the elements 200. The loading plate 10 on the top serves as a cover and does not receive the elements 200. The spacer blocks 112 are received in the notches 165 to align the corresponding through holes 13 of the loading plates 10. The two rubber bands 51 sleeve on the loading plates 10 to fix the loading plates 10 together. The loading device 100 loaded with the elements 200 is put into a cleaning machine (not shown). An amount of cleaning fluid in the cleaning machine is shook, along the direction perpendicular to the second surface 16. The cleaning fluid reaches the elements 200 through the intervals 113 of two adjacent loading plates 10, along the direction parallel to the second surface 16. The cleaning fluid reaches the elements 200 through the second holes 132, and thus the element 200 can be cleaned from multi-angles. Then, the loading device 100 and the elements 200 are taken from the cleaning device, and are put into a drying machine. The two rubber bands 51 are removed. After the elements 200 are dried, the elements 200 loaded on each loading plate 10 are put into an assembly machine (not shown) in turn.

In other embodiments, the shape of the first hole 131 and the second hole 132 also can be other shapes, e.g. square, or rhombus. The shape of the groove 163 also can be other shapes, e.g. square, or rhombus.

In other embodiments, the diameter of the first hole 131 is equal to that of the second hole 132.

In other embodiments, the number of the blocks 160 surrounding a second hole 132 can also be three, or more than four.

In other embodiments, the diameter of the groove 163 can also be unequal to that of the first hole 131, but the diameter of the second hole 132 must less than that of the groove 163.

In other embodiments, the second hole 132 also can be located off the center of the groove 163.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A loading device for loading elements, comprising:

at least two loading plates configured for loading a plurality of elements, the at least two loading plates being stacked one by one, each loading plate defining a plurality of through holes and comprising:

a first surface;

a plurality of spacer blocks positioned on the first surface to form an interval between two adjacent loading plates;

a second surface opposite to the first surface; and a plurality of blocks positioned on the second surface, wherein the through holes pass through the first and second surfaces, each through hole is surrounded by at least three blocks, each of the at least three blocks has an arc surface facing a corresponding through hole, the arc surfaces of the at least three blocks cooperatively define a groove communicating with the corresponding through hole; and a fixing assembly fixing the at least two loading plates together.

2. The loading device of claim 1, wherein each of the through holes comprises a first hole and a second hole coaxial with the first hole, the first hole is adjacent to the first surface, the second hole is adjacent to the second surface, a diameter of the first hole is larger than that of the second hole, each groove of one loading plate and a corresponding first hole of another adjacent loading plate are configured to cooperatively receive one of the elements, each groove is circular shaped, and a diameter of each first hole is less than that of each groove.

3. The loading device of claim 1, wherein each loading plate is substantially square-shaped, each two spacer blocks are positioned on one side of each second surface, and each two spacer blocks on two opposite sides are aligned with each other.

4. The loading device of claim 1, wherein the through holes are arranged in an array, and two adjacent through holes are spaced from each other.

5. The loading device of claim 1, wherein the blocks are arranged in an array, and two adjacent blocks are spaced from each other.

6. The loading device of claim 1, wherein the fixing assembly comprises two rubber bands, the rubber bands bind the at least two loading plates together.

7. The loading device of claim 1, wherein each loading plate is substantially square-shaped, the blocks comprises a plurality of middle blocks, a plurality of side blocks, and a plurality of corner blocks, the side blocks are arranged adjacent to four sides of each second surface, the corner blocks are arranged in four corners of each second surface, the middle blocks are arranged in an array surrounded by the side blocks and the corner blocks.

8. The loading device of claim 7, wherein each middle block is substantially square-shaped, a cross-sectional area of each side block is half of that of each middle block, a cross-sectional area of each corner block is quarter of that of each middle block.

9. The loading device of claim 7, wherein a cross-sectional area of each side block and a cross-sectional area of each corner block are the same as that of each middle block.

10. The loading device of claim 1, wherein each second surface comprises a plurality of sides, each side defines a notch receiving corresponding spacer blocks of adjacent loading plate.

11. The loading device of claim 1, wherein each two adjacent blocks cooperatively a channel, two adjacent grooves are communicated through a corresponding channel.

12. The loading device of claim 1, wherein each through hole is surrounded by four blocks.

* * * * *